US006710549B2

(12) United States Patent
Okada et al.

(10) Patent No.: US 6,710,549 B2
(45) Date of Patent: Mar. 23, 2004

(54) DRIVING METHOD FOR MATRIX TYPE ORGANIC EL ELEMENT AND MATRIX TYPE ORGANIC EL APPARATUS

(75) Inventors: Hiroyuki Okada, Toyama (JP); Shigeki Naka, Toyama-ken (JP); Hiroyoshi Onnagawa, Toyama (JP)

(73) Assignee: President of Toyama University, Toyama (JP)

( * ) Notice: Subject to any disclaimer, the term of this patent is extended or adjusted under 35 U.S.C. 154(b) by 0 days.

(21) Appl. No.: 10/389,952

(22) Filed: Mar. 18, 2003

(65) Prior Publication Data

US 2003/0193298 A1 Oct. 16, 2003

(30) Foreign Application Priority Data

Mar. 26, 2002 (JP) ..... 2002-086993

(51) Int. Cl.[7] ..... G09G 3/10

(52) U.S. Cl. ..... 315/169.3; 315/169.1; 345/204; 345/55

(58) Field of Search ..... 315/169.3, 169.1, 315/169.2, 169.4; 345/204, 55, 76–84

(56) References Cited

U.S. PATENT DOCUMENTS 5,006,838 A * 4/1991 Fujioka et al. ..... 315/169.3
5,923,309 A * 7/1999 Ishizuka et al. ..... 345/82
6,426,595 B1 * 7/2002 Odake et al. ..... 315/169.1
2001/0050662 A1 * 12/2001 Kota et al. ..... 345/76

* cited by examiner

*Primary Examiner*—James Clinger
*Assistant Examiner*—Ephrem Alemu
(74) *Attorney, Agent, or Firm*—Oblon, McClelland, Maier & Neustadt, P.C.

(57) ABSTRACT

The driving method for a matrix type organic EL element comprises the steps of selectively applying an identical scanning voltage amplitude pattern to the plurality of row direction electrodes of two or more rows in accordance with the scanning voltage amplitude pattern applied to the row direction electrodes to simultaneously scan the electrodes, separately applying a signal voltage pattern, which is applied to the column direction electrodes, to the electrodes simultaneously scanned in the row direction through two sets or more of the plurality of column direction electrodes which are independent of each other, and simultaneously scanning two or more of a plurality of scanning lines to thereby form image information to be displayed in one frame.

6 Claims, 5 Drawing Sheets

DRIVING METHOD FOR MATRIX TYPE ORGANIC EL ELEMENT AND MATRIX TYPE ORGANIC EL APPARATUS

CROSS-REFERENCE TO RELATED APPLICATIONS

This application is based upon and claims the benefit of priority from the prior Japanese Patent Application No. 2002-086993, filed Mar. 26, 2002, the entire contents of which are incorporated herein by reference.

BACKGROUND OF THE INVENTION

1. Field of the Invention

The present invention relates to a driving method and a driving apparatus for a display panel using an organic EL element. More particularly, in an organic EL matrix panel based on the multiple line driving method, a driving method is achieved which is capable of obtaining sufficient luminance necessary for the matrix panel and which improves the reliability of an organic EL element, without applying an excessive voltage for high duty drive to the organic EL element that forms pixels.

2. Description of the Related Art

The organic EL elements are now being commercialized as information displays having characteristics such as spontaneous light, high luminance, high efficiency and light weight mainly in compact panels and portable information terminals. Displaying types for the displays are generally classified into the following types: an active matrix type having an active device such as, for example, an FET and a charge storage capacitor for each pixel, and a passive type having a plurality of electrodes that expand simply in row and column directions, and for forming an image by selecting intersection points thereof to emit light.

In the active matrix type, the FET circuit and the charge storage capacitor are disposed at a positive pole of each pixel, and a voltage applied to each pixel by the stored charge of the capacitor is maintained for a certain period of time. The active matrix type has a system in which each pixel is selected once in one frame of a screen display while luminance information to be displayed is sent thereto, and the same voltage is applied to the organic EL element constituting the pixels constantly during one frame, thereby performing each display. Therefore, in the active matrix type, 100% duty drive is possible. However, there is a problem that the FET circuit constituted of, for example, a TFT, and the capacitor must both be formed on the same substrate, together with each organic EL element.

On the other hand, in the passive type, a plurality of anode electrodes and a plurality of cathode electrodes are formed into strips via an organic EL thin film, in such a way that they cross each other at right angles, thereby preparing a matrix structure in which the luminescence of the organic EL thin film is controlled by the row electrodes and column electrodes at orthogonal points. Since the response speed of an organic EL element is usually 1 $\mu$s or less, scanning display due to this matrix structure is possible. The advantage of the passive type is that production costs can be reduced since the configuration of the element is simple and the accuracy of processing is not required as severely as in the active matrix type.

Furthermore, in the passive type, the organic EL thin film element has rectification properties that can adequately suppress crosstalk caused by a current flowing in the opposite direction, and has such characteristics that a high-capacity panel can be driven with a simple drive waveform. For this reason, most of the organic EL element panels in present use utilize the passive type.

FIG. 1 schematically shows a conventional passive type display panel and its control circuit. In a display panel 1, a plurality of strip-shaped anodes 3 made of a transparent electrode material such as indium tin oxide (ITO) are formed in parallel with each other on the surface of a transparent substrate 2. An organic light emitting layer 4 is formed covering the plurality of anodes 3, and on its upper surface, a plurality of strip-shaped cathodes 5 constituted of a metallic thin film are formed in parallel with each other. The anodes 3 and cathodes 5 are usually formed to cross each other at right angles, and the organic light emitting layer at each intersection 6 forms a pixel. In the example shown in FIG. 1, a plurality of pixels of N rows×M columns (N=10, M=10) are arranged as matrix elements.

Each of the strip-shaped anodes 3 are connected to a data electrode driving portion 7, and each of the strip-shaped cathodes 5 is connected to a scanning electrode driving portion 8. The data electrode driving portion 7 and scanning electrode driving portion 8 are controlled by a display control portion 9, and the display control portion 9 is controlled by a main control portion 13 for receiving a video signal 30 and controlling the operation of the entire panel.

Light emission processing for one frame period of the display panel is performed in such a way that the scanning electrode driving portion 8 first sequentially selects each cathode 5 in 1 to N (rows) so as to enable each row to be conductive. The luminance of each pixel belonging to each selected row is controlled by the data electrode driving portion 7 by corresponding conduction state of each corresponding row with the signal strength of the video signal 30 by means of 1 to M (columns) of the anodes 3.

However, for a passive type display panel, as shown in FIG. 1, because the electrodes in N rows constituting the matrix are sequentially scanned so that light may be emitted for each row, each pixel emits light only for one selected period among N scannings within one frame period. Thus, in order to obtain the luminance necessary for the display panel by the driving only within a period of a duty ratio (1/N) at which each selected pixel can operate, each organic EL element needs to emit light with a luminance N times as high as the luminance to be actually displayed.

Therefore, due to the driving at such a low duty ratio, the highest luminance of the organic EL element itself must be further enhanced. In addition, when driving current density is increased, to obtain a high luminance, a problem arises that luminous efficiency of the organic EL element is decreased. Further, since it is necessary to, although in an instant, perform driving at high current density, such a problem is caused that current deterioration of the organic EL element is accelerated.

BRIEF SUMMARY OF THE INVENTION

This invention has been achieved in view of the foregoing prior art problems, and the invention relates to a driving method and driving system for an organic EL element panel capable of improving a duty ratio of the prior art. Therefore, one object of this invention is to accomplish a driving method which, in the driving of the organic EL matrix panel based on a multiple line driving method, enables the matrix panel to have a sufficient luminance, without driving the organic EL element in accordance with an inappropriate duty ratio, which improves the reliability of the organic EL element.

According to an embodiment of the present invention, provided is a driving method for a matrix type organic EL element which has a plurality of row direction electrodes and a plurality of column direction electrodes arranged via an organic light emitting layer and which is capable of displaying a predetermined image, the method comprising:

selectively applying an identical scanning voltage amplitude pattern to the plurality of row direction electrodes of two or more rows in accordance with the scanning voltage amplitude pattern applied to the row direction electrodes to simultaneously scan the electrodes;

separately applying a signal voltage pattern, which is applied to the column direction electrodes, to the electrodes simultaneously scanned in the row direction through two or more sets of the plurality of column direction electrodes which are independent of each other; and simultaneously scanning two or more of a plurality of scanning lines, whereby image information to be displayed in one frame is formed.

Furthermore, the driving method for the organic EL element can be provided which comprises the steps of: integrally forming the two or more adjacent rows of the plurality of row direction electrodes as one set of electrodes; and separately driving by the plurality of column direction electrodes.

Still further, the driving method for the organic EL element can be provided which comprises the step of: providing low-resistance wiring electrodes as auxiliary electrodes connected to each image display portion of the column direction electrodes.

According to an embodiment of the present invention, the present invention can provide a matrix type organic EL apparatus which has a plurality of row direction electrodes and a plurality of column direction electrodes arranged via an organic light emitting layer and which is capable of displaying a predetermined image, and the apparatus has:

means for selectively and simultaneously applying an identical scanning voltage amplitude pattern to the plurality of row direction electrodes of two or more rows; and two sets or more of the plurality of independent column electrodes for separately applying a signal voltage pattern, which is to be applied to the column direction electrodes, to the row direction electrodes simultaneously scanned in the row direction, wherein two or more of a plurality of scanning lines are simultaneously scanned, and image information to be displayed in one frame is thereby formed.

Furthermore, the organic EL apparatus can be provided in which the two or more adjacent rows of the plurality of row direction electrodes are integrally formed as one set of row direction electrodes, and the organic EL apparatus can be provided in which low-resistance wiring electrodes are provided as auxiliary electrodes connected to each display portion of the column direction electrodes.

DETAILED DESCRIPTION OF THE INVENTION

Figure 1:
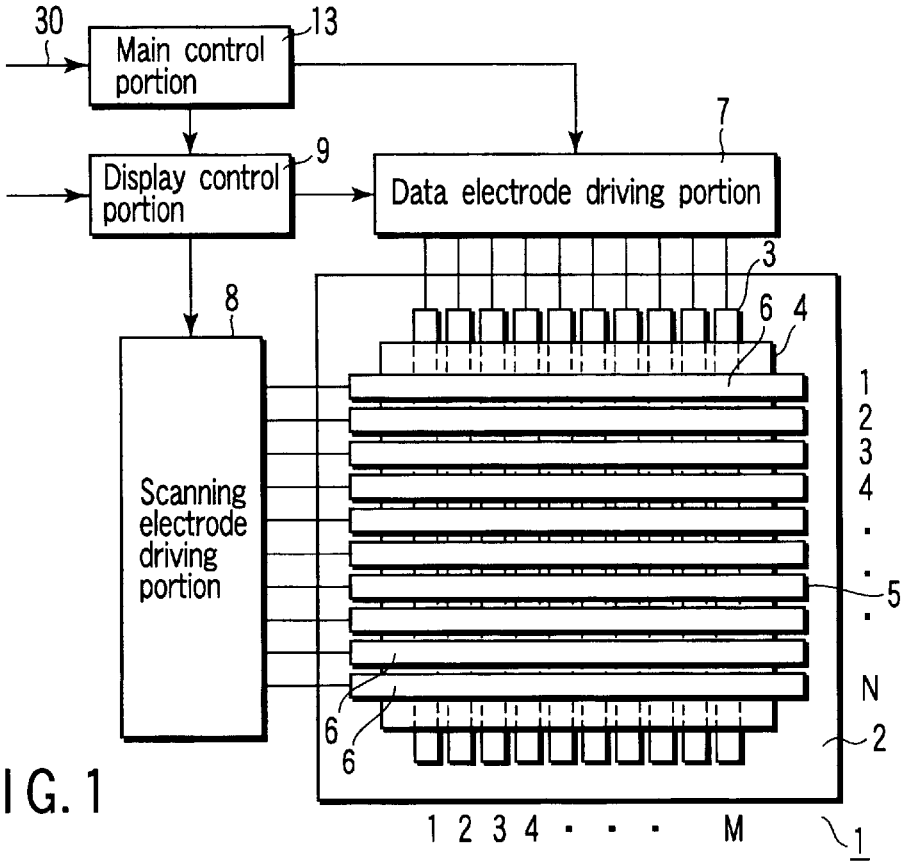
FIG. 1 is a diagram showing a conventional passive type organic electroluminescence display panel and its control circuit.

The present invention will hereinafter be described in detail in accordance with specific embodiments shown in the accompanying drawings. In the description of the embodiments below and the illustration in the drawings of the present invention, like reference numerals indicate like elements.

Methods and configurations described in the present specification are all applicable to a multiple line driving of two lines or more, but for the description of the configuration and operation according to the present invention to be easily understood, an embodiment in accordance with double line driving will hereinafter be described as an example.

Figure 2:
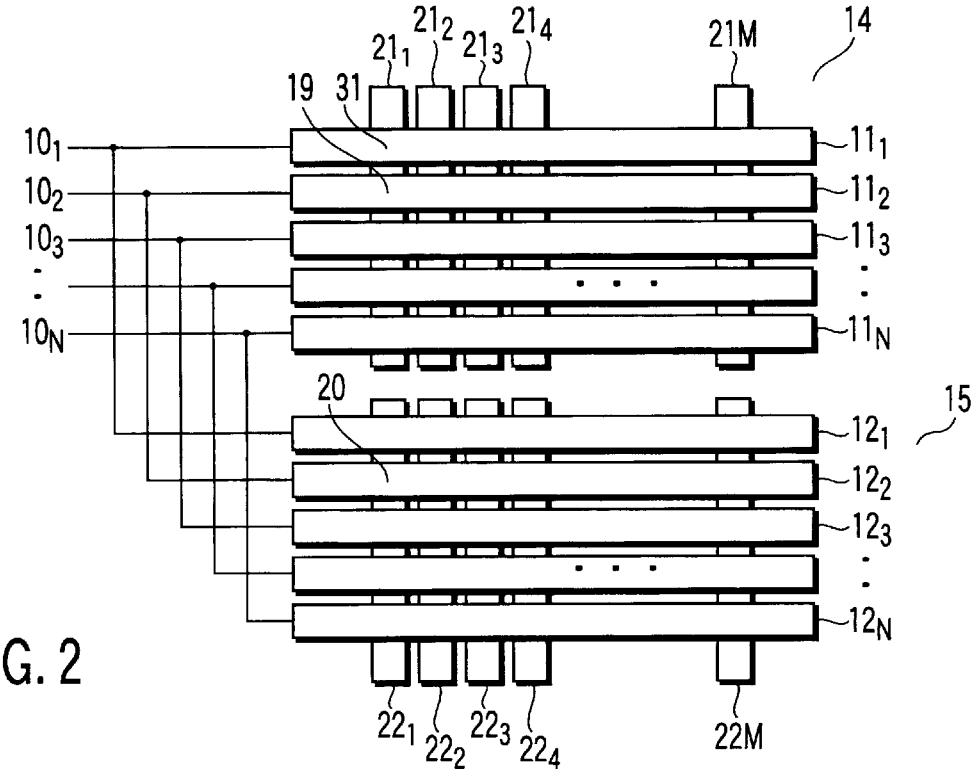
FIG. 2 is a basic constitutional view of an organic electroluminescence element based on a double line driving method according to the present invention.

FIG. 2 shows a basic configuration of an organic electroluminescence element display based on a double line driving method according to the present invention. This display is a matrix type organic electroluminescence element capable of displaying various gradations, colors and optional shapes, for example. Color specification does not particularly limits the present invention, and known methods can be applied as the color specification of the normal organic electroluminescence element.

In FIG. 2, the display is divided into two upper and lower portions. $\mathbf{10}_1$, $\mathbf{10}_2$, $\mathbf{10}_3$, . . . , $\mathbf{10}_{N-1}$, $\mathbf{10}_N$ on the left side are no. 1, 2, 3 . . . , N−1, N row wires in the display and used in common in the divided two upper and lower portions. Horizontally extending electrodes $\mathbf{11}_1$, $\mathbf{11}_2$, $\mathbf{11}_3$, . . . , $\mathbf{11}_N$ respectively connected to the above row wires are a first set of no. 1, 2, 3 . . . , N (upper) row electrodes, and $\mathbf{12}_1$, $\mathbf{12}_2$, $\mathbf{12}_3$, . . . , $\mathbf{12}_N$ are a second set of no. 1, 2, 3 . . . , N (lower) row electrodes.

Vertically extending electrodes $\mathbf{21}_1$, $\mathbf{21}_2$, $\mathbf{21}_3$, $\mathbf{21}_4$, . . . , $\mathbf{21}_M$ are a first set of no. 1, 2, 3, 4 . . . , M (upper) column electrodes, and $\mathbf{22}_1$, $\mathbf{22}_2$, $\mathbf{22}_3$, $\mathbf{22}_4$, $\mathbf{22}_M$ are a second set of no. 1, 2, 3, 4 . . . , M (lower) column electrodes.

A control signal for row scanning is sequentially applied to the common row wires $\mathbf{10}_1$, $\mathbf{10}_2$, $\mathbf{10}_3$, $\mathbf{10}_{N-1}$, $\mathbf{10}_N$ on a time division basis totally without reference to a signal image. On the other hand, signal voltage patterns corresponding to each luminance to be displayed in the row presently targeted for scanning are applied respectively at the same time to column wires (not shown) connected to the electrode columns $\mathbf{21}_1$, $\mathbf{21}_2$, $\mathbf{21}_3$, $\mathbf{21}_4$, . . . $\mathbf{21}_M$ and the electrode columns $\mathbf{22}_1$, $\mathbf{22}_2$, $\mathbf{22}_3$, $\mathbf{22}_4$, . . . , $\mathbf{22}_M$ respectively.

Figure 3:
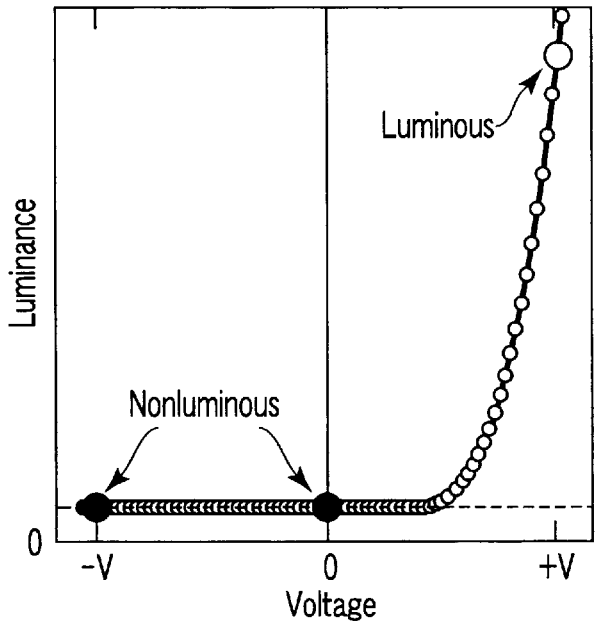
FIG. 3 is a graph showing the relationship between a voltage applied to the organic electroluminescence element and the luminance.

FIG. 3 shows the relation of luminance to a voltage applied to the organic electroluminescence element. For example, FIG. 4 shows one example of the time-related change of one portion of the control voltage applied to the organic electroluminescence element panel, when it emits light with a certain degree of luminance.

Consider now the case where, for example, an intersection 31 of the row $\mathbf{21}_1$ and column $\mathbf{11}_1$ of the N rows×M columns matrix panel in FIG. 2 emits light with a certain degree of luminance.

Figure 4:
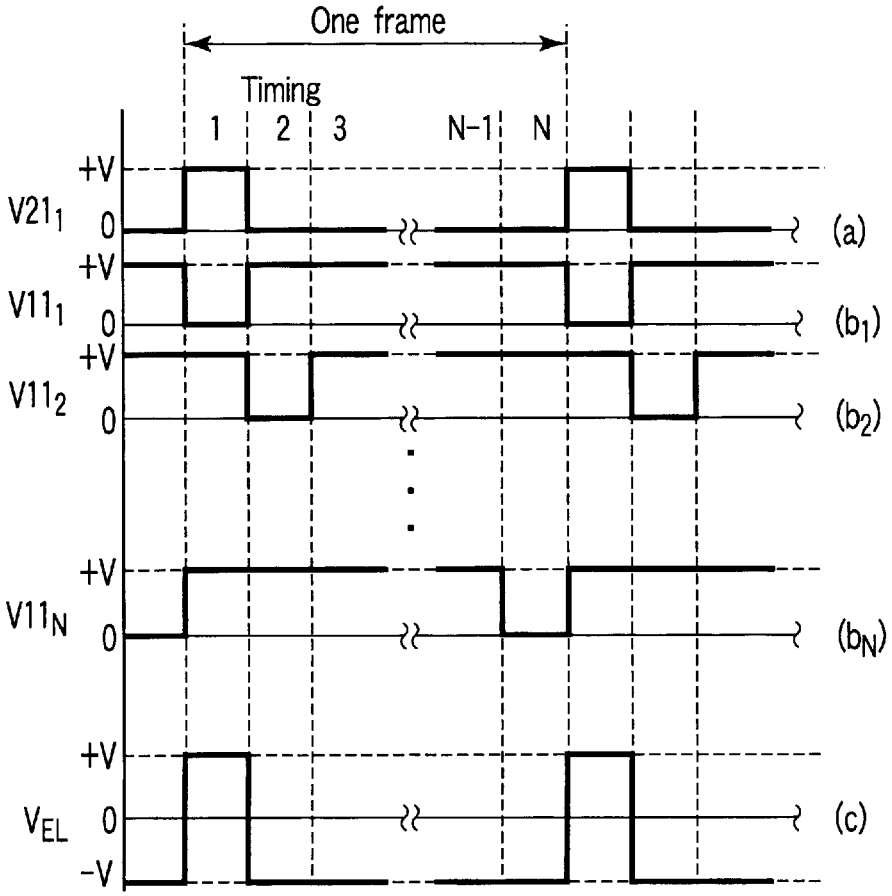
FIG. 4 is a diagram showing one example of the time-related change of voltage waveforms of the passive type driving organic electroluminescence element.

In FIG. 4, (a) indicates the time-related change of a voltage $V21_1$, which is a luminance signal voltage applied to the row electrode $\mathbf{21}_1$. $(b_1)$, $(b_2)$ . . . $(b_N)$ indicate the time-related change of voltages $V11_1$, $V11_2$, . . . , $V11_N$ respectively applied to the row electrodes $\mathbf{11}_1$, $\mathbf{11}_2$, . . . , $\mathbf{11}_N$ on a scanned side. (c) indicates the time-related change of a voltage $V_{EL}$ applied to the organic electroluminescence element in the portion of the intersection 31.

Successive selection of the row electrodes $\mathbf{11}_1$, $\mathbf{11}_2$, $\mathbf{11}_3$, $\mathbf{11}_4$, . . . , $\mathbf{11}_N$ for one frame period are performed by sequentially changing the voltage applied to the row electrodes from +V to 0, and then returning it from 0 to +V after each selection period. Signals are applied to the column electrodes with 0V in a pixel region where light is not emitted and +V in a pixel region where light is emitted, thereby enabling light emission with a certain degree of luminance in a predetermined pixel region on a horizontal scanning line of the display. Timing numbers 1, 2 . . . N are indicated at the top.

Here, at a timing 1, the voltage +V is applied to the $V21_1$, and the voltage 0 to the $V11_1$. The voltage applied to the $V11_2$ to $V11_N$ that are not scanned apart from the $V11_1$ is +V. In this state, the voltage +V is applied as $V_{EL}$ to the selected intersection 31 of FIG. 2 as indicated by (c), and thus the region of this selected intersection 31 emits light. On the other hand, +V is applied to the other row electrodes $\mathbf{11}_2$, $\mathbf{11}_3$, $\mathbf{11}_4$, . . . , $\mathbf{11}_N$, and 0V biases between the row electrodes $\mathbf{11}_2$, $\mathbf{11}_3$, $\mathbf{11}_4$, . . . , $\mathbf{11}_N$ and the column electrode $V21_1$, so that these areas will be in a nonluminous state.

At a timing 2, the next row $\mathbf{11}_2$ is scanned, and then each intersection of the row electrode $\mathbf{11}_2$ and the column electrodes $\mathbf{21}_1$, $\mathbf{21}_2$, $\mathbf{21}_3$, $\mathbf{21}_4$, . . . , $\mathbf{21}_M$ generally emits light or is in the nonluminous state, in connection with the signal voltage applied to the voltages $V21_1$, $V21_2$, . . . , $V21_M$, which are applied to the column electrodes $\mathbf{21}_1$, $\mathbf{21}_2$, $\mathbf{21}_3$, $\mathbf{21}_4$, . . . , $\mathbf{21}_M$. In the case of FIG. 4, at the timing 2, 0V is applied to the column electrode $\mathbf{21}_1$ selected at the timing 1. This causes the $V_{EL}$ at the intersection 31 to be −V, leading the intersection 31 into the nonluminous state. Even if +V were applied to the column electrode $\mathbf{21}_1$ at the timing 2, the $V_{EL}$ would be 0V (not shown), and the intersection 31 in an unselected state would be in the nonluminous state.

As above, the intersection will be in a luminous state when the voltage applied to the organic electroluminescence element is +Vn, and in a nonluminous state when the voltage is 0 or −V, thereby enabling the matrix panel to be driven. Therefore, when a desired luminance is to be obtained by means of the voltage applied to each organic electroluminescence element, the relationship between the voltage applied to each organic electroluminescence element and the luminance is important. In general, in the organic electroluminescence element with favorable characteristics, its luminance is essentially proportionate to a current flowing in its organic electroluminescence element portion in a broad range.

Thus, easy selection driving without problems such as electrode resistance is possible by current driving of each organic electroluminescence element portion. Specifically, the column electrodes $\mathbf{21}_1$, $\mathbf{21}_2$, $\mathbf{21}_3$, $\mathbf{21}_4$, . . . , $\mathbf{21}_M$ of the actual luminous panel are desirably driven selectively by a current driving power source by which currents are controlled in response to the amplitude of a video signal 30, respectively.

The description returns to FIG. 2. The display panel of FIG. 2 here comprises the basically equivalent upper and lower two display portions 14 and 15, the same scanning signal is applied at the same timing to the wires of pairs of the row wires $\mathbf{11}_1$ and $\mathbf{12}_1$, $\mathbf{11}_2$ and $\mathbf{12}_2$, $\mathbf{11}_3$ and $\mathbf{12}_3$, . . . , $\mathbf{11}_N$ and $\mathbf{12}_N$. On the contrary, a data signal corresponding to the luminance of the display portions is applied to the column wires $\mathbf{21}_1$, $\mathbf{21}_2$, $\mathbf{21}_3$, $\mathbf{21}_4$, . . . , $\mathbf{21}_M$, and $\mathbf{22}_1$, $\mathbf{22}_2$, $\mathbf{22}_3$, $\mathbf{22}_4$, . . . , $\mathbf{22}_M$, thereby allowing information display, that is, image display corresponding to each portion at each timing.

Considering the scanning time within one frame in the case of FIG. 2, the normal matrix panel of N rows×M columns is scanned with a 1/N duty, whereas it is scanned with a 2/N duty in accordance with the configuration of FIG. 2. Therefore, considering that light is emitted with the same luminance within one frame, an instantaneous peak luminance during the time when each pixel is being scanned can be half of that of the N rows×M columns matrix panel.

Furthermore, in the configuration of the organic electroluminescence element panel of FIG. 2, when an indium tin oxide (ITO) electrode or an indium zinc oxide (IZO) electrode, which are generally high-resistance anode materials as compared with electrode materials generally used, is used as a wiring material for the column electrodes $\mathbf{21}_1$, $\mathbf{21}_2$, $\mathbf{21}_3$, $\mathbf{21}_4$, . . . , $\mathbf{21}_M$ and $\mathbf{22}_1$, $\mathbf{22}_2$, $\mathbf{22}_3$, $\mathbf{22}_4$, . . . , $\mathbf{22}_M$ in the upper portion 14 and lower portion 15 in the drawing, such an advantage is obtained that the resistance of the column electrodes can be substantially reduced, since the length of each electrode is half. Thus, a voltage drop due to serial resistance effects is reduced in each element, so that response time can be shortened.

Generally, in the configuration of the organic electroluminescence element, the electrode (cathode 5) after the organic material is formed is formed by a method such as deposition, in association with chemical resistance and adhesion properties of an organic material 4. Therefore, in the most convenient method that can keep the electrode shape of FIG. 2 unchanged, although this is not an exclusive method, it is desirable that, after an anode such as ITO to be the column electrode in which patters are formed in advance is produced, an organic thin film is formed by deposition, and finally the electrode 5 to be the common row electrode is formed by such a method as mask deposition.

Figure 5:
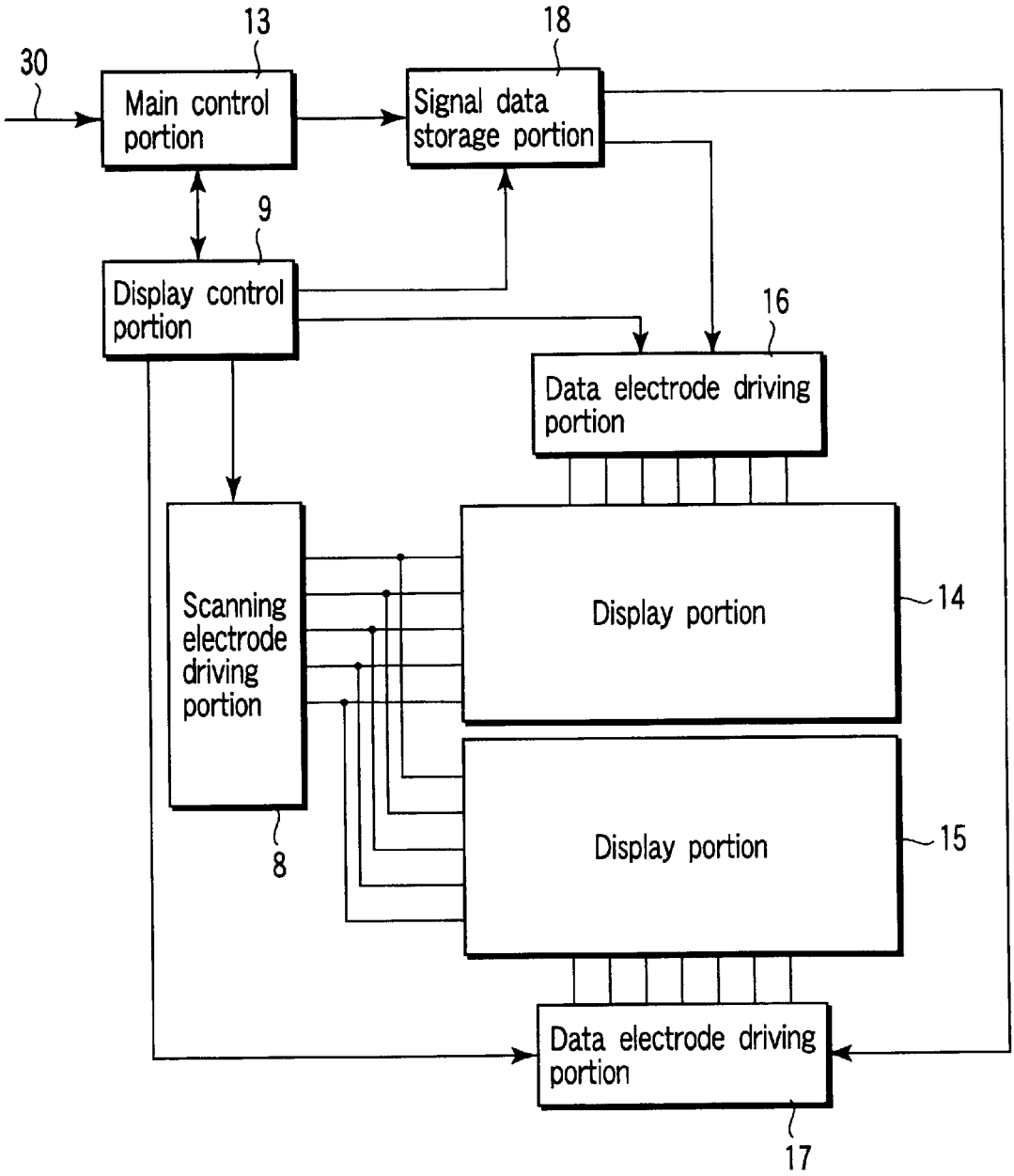
FIG. 5 is a diagram showing a display panel based on the double line driving method and its control circuit according to the present invention.

FIG. 5 schematically shows the display panel and its control circuit in the embodiment of FIG. 2. The main difference from the conventional display panel and its control circuit shown in FIG. 1 is in that the display panel is formed with a plurality of equivalent display portions 14 and 15, as described above. The row electrode (not shown) of each display portion is driven by a scanning electrode diving portion 8 common to the display portions, but the point is that the column electrodes (not shown) are driven by each of the data electrode driving portions 16 and 17 that are separately provided in each display portion.

The continuous data signal 30 constituting one frame is sequentially divided into a plurality of continuous data signals in accordance with the number of display portions 14 and 15. Each divided signal portion is once stored in a signal data storage portion 18. Each corresponding piece of data is sent to each of the electrode driving portions 16 and 17, and by controlling each corresponding pixel to emit light at the same time in each of the display portions 15 and 16 synchronously with the signal of the common scanning electrode driving portion, an image is reproduced as one entire display panel image.

Figure 6:
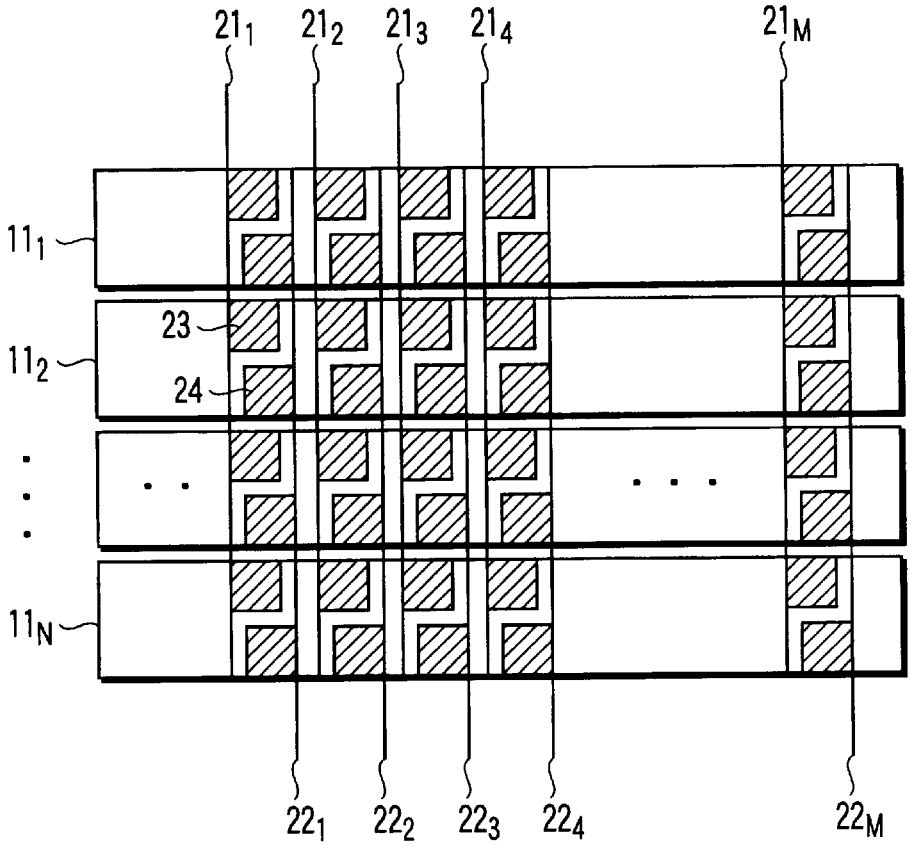
FIG. 6 is a diagram showing one example of electrode arrangement when the double line driving method is used according to the present invention.
Figure 7:
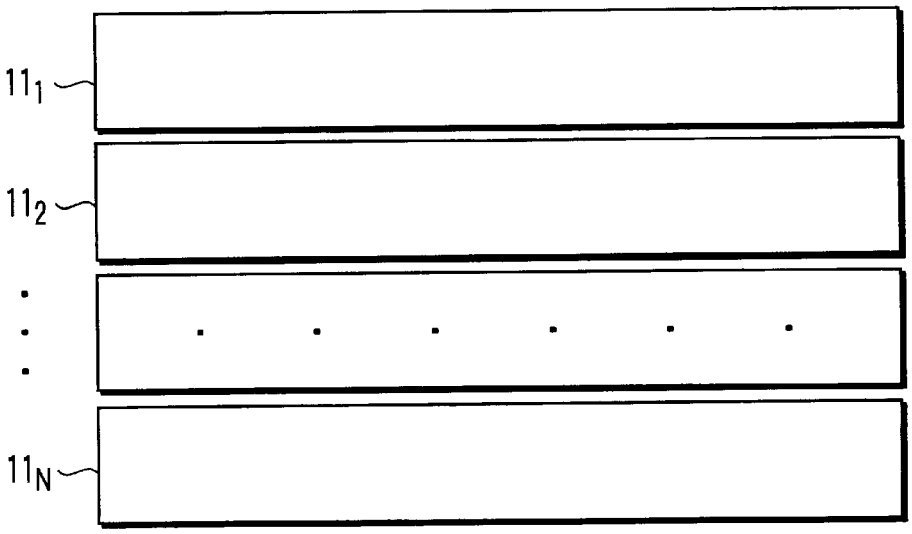
FIG. 7 is a diagram showing the arrangement of row electrodes according to the present invention.
Figure 8:
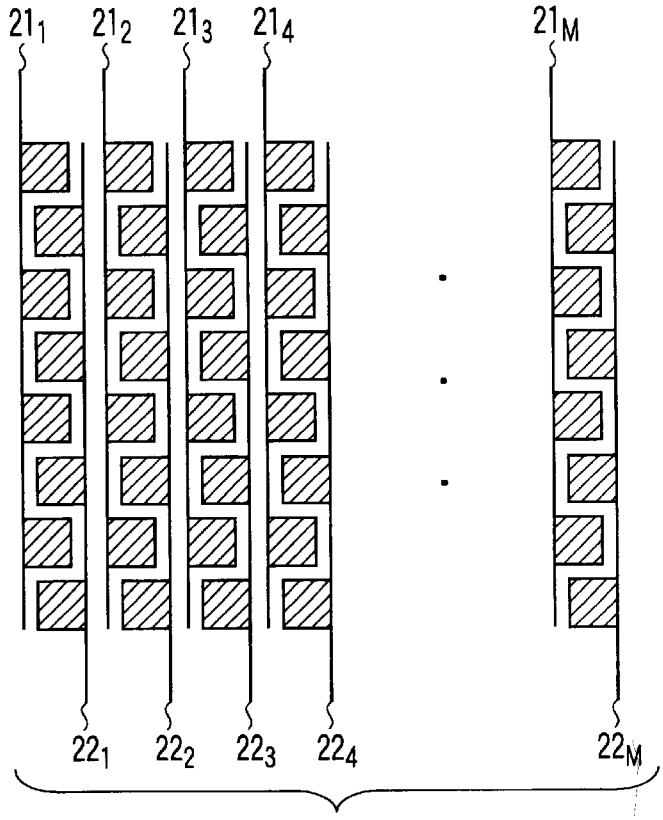
FIG. 8 is a diagram showing the arrangement of column electrodes according to the present invention.

FIG. 6, FIG. 7 and FIG. 8 show a concrete example of the row and column electrodes in an alternative embodiment. Here, FIG. 6 shows the arrangement of the electrodes in accordance with the double line driving method in the alternative embodiment, and $\mathbf{11}_1$, $\mathbf{11}_2$, $\mathbf{11}_3$, . . . , $\mathbf{11}_N$ indicate a set of no. 1, 2, 3, . . . , N row electrodes. $\mathbf{21}_1$, $\mathbf{21}_2$, $\mathbf{21}_3$, $\mathbf{21}_4$, . . . , $\mathbf{21}_M$ indicate a first set of no. 1, 2, 3, 4 . . . , M column electrodes. Further, $\mathbf{12}_1$, $\mathbf{12}_2$, $\mathbf{12}_3$, . . . , $\mathbf{12}_N$ indicate a second set of no. 1, 2, 3 . . . , N row electrodes, and $\mathbf{22}_1$, $\mathbf{22}_2$, $\mathbf{22}_3$, $\mathbf{22}_4$, . . . , $\mathbf{22}_M$ indicate a second set of no. 1, 2, 3, 4 . . . , M column electrodes.

FIG. 7 here shows an example of a row electrode arrangement, and $\mathbf{11}_1$, $\mathbf{11}_2$, . . . , $\mathbf{11}_N$ respectively indicate no. 1, 2, 3, . . . , N row electrodes. FIG. 8 shows the constitution of column electrodes, and $\mathbf{21}_1$, $\mathbf{21}_2$, $\mathbf{21}_3$, $\mathbf{21}_4$, . . . , $\mathbf{21}_M$ indicate a first set of column electrodes, and $\mathbf{22}_1$, $\mathbf{22}_2$, $\mathbf{22}_3$, $\mathbf{22}_4$, . . . , $\mathbf{22}_M$ indicate a second set of column electrodes. FIG. 6 shows the first set of column electrodes $\mathbf{21}_1$, $\mathbf{21}_2$, $\mathbf{21}_3$, $\mathbf{21}_4$, $\mathbf{21}_M$ and the second set of column electrodes $\mathbf{22}_1$, $\mathbf{22}_2$, $\mathbf{22}_3$, $\mathbf{22}_4$, . . . , $\mathbf{22}_M$ of FIG. 8 that are disposed via an organic luminous film (not shown) on the row electrodes $\mathbf{11}_1$, $\mathbf{11}_2$, . . . $\mathbf{11}_N$ of FIG. 7.

A crossing electrode constitution, given only as an example of a convenient constitution, would be built by such a form that two row scanning electrodes are commonly driven, and a voltage is independently applied to each of the upper and lower column signal electrodes.

For example, second electrode regions 19 and 20 from the top of the column electrodes $\mathbf{21}_1$ and $\mathbf{22}_1$ (two sets in this case) formed under the two different sets of row electrodes $\mathbf{11}_1$, $\mathbf{11}_2$, . . ., $\mathbf{11}_N$ and $\mathbf{12}_1$, $\mathbf{12}_2$, . . . , $\mathbf{12}_N$ in the embodiment of FIG. 2, are formed as adjacent electrode regions 23 and 24 on the same second electrode $\mathbf{11}_2$ from the top in the case of FIG. 6, and then a simultaneous luminance data signal is applied, thus controlling light emission, as in FIG. 2.

Figure 9:
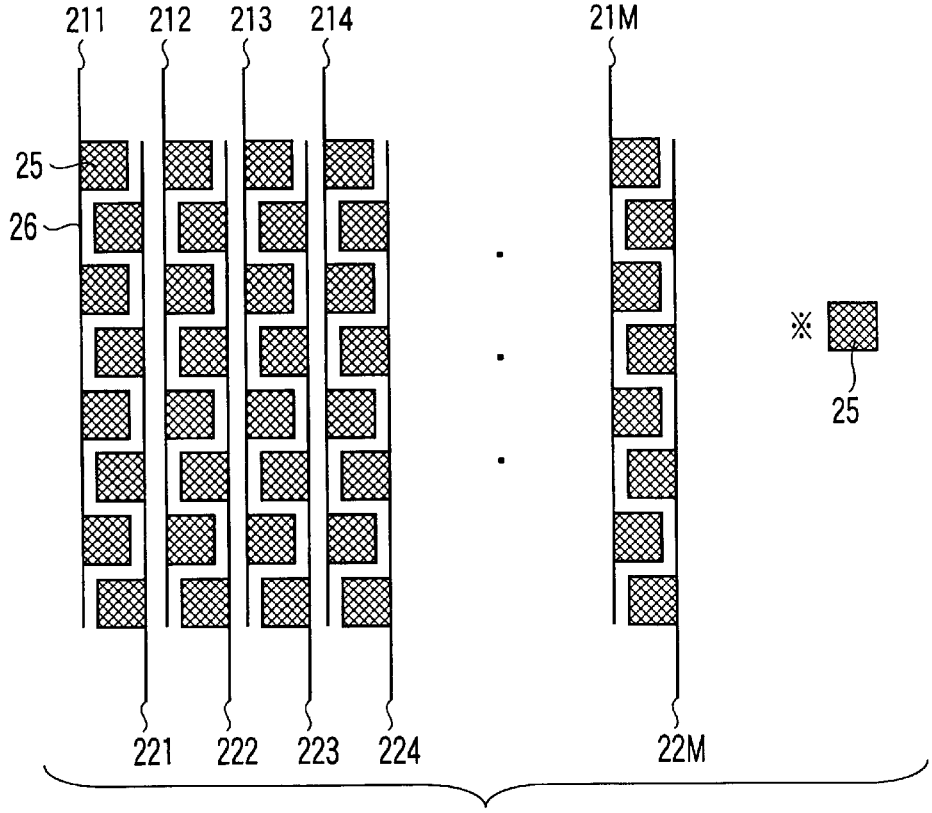
FIG. 9 is a diagram showing an example where the column electrodes are constituted of a light emitting portion and low resistance auxiliary wiring in the present invention.

FIG. 9 shows a further alternative embodiment, and an example of an arrangement where the column electrodes are constituted with a combination of an electrode 25 of a light emitting portion and an auxiliary wire 26 made of a low-resistance metallic material such as gold. $\mathbf{21}_1$, $\mathbf{21}_2$, $\mathbf{21}_3$, $\mathbf{21}_4$, . . . , $\mathbf{21}_M$ are the first set of no. 1, 2, 3, 4, . . . , M column electrodes. $\mathbf{22}_1$, $\mathbf{22}_2$, $\mathbf{22}_3$, $\mathbf{22}_4$, . . . , $\mathbf{22}_M$ are the second set of no. 1, 2, 3, 4, . . . , M column electrodes. 25 is the electrode of the light emitting portion. Basically, the organic thin film is formed on the entire surface.

The double line driving method has been given as an example of a multiple line driving method in the above embodiments, but in a selecting method of a plurality of lines, such as triple lines or four lines, the same line selection can be performed as in the above embodiments, so that impossible driving conditions for the organic electroluminescence element can be eliminated and sufficient luminance can be achieved.

An example of basic characteristics of the organic EL light emitting element used for the implementation of the present invention will be described below. To check an initial operation, a 14 row×16 column panel is experimentally produced as the organic electroluminescence element panel, and its operation is examined. In the constitution of the element, an ITO electrode is used for the anode and an Al electrode for the cathode, thus producing an element having an ITO/triphenylamine derivative/Al quinolinol complex/LiF/Al constitution. The width of the ITO electrode is 450 $\mu$m, and the auxiliary wiring similar to that of FIG. 9 is formed of Al. The width of the cathode electrode is 2 mm. Driving patterns are constituted by means of a ROM for computer writing, and a multi-purpose IC which is a general IC for driving a shift register or the like. The typical luminance is 2,370 cd/m$^2$ with 6.1 V, 100 mA/cm$^2$. A favorable response is achieved with a voltage drop of less than 0.4 V at the end of the device, and a luminous response of less than 5 $\mu$s.

The embodiments of the present invention have been illustrated in the drawings and described above, but the embodiments of the present invention described herein are given as mere examples, and it is apparent that various modifications may be made without departing from the technical scope of the present invention.

As shown above, it is possible to achieve a driving having sufficient luminance, and an improvement in reliability, without performing impossibly high duty driving, in an organic EL matrix panel based on the multiple line driving method.

What is claimed is:

1. A driving method for a matrix type organic EL element which has a plurality of row direction electrodes and a plurality of column direction electrodes arranged via an organic light emitting layer and which is capable of displaying a predetermined image, the method comprising:

selectively applying an identical scanning voltage amplitude pattern to the plurality of row direction electrodes of two or more rows in accordance with the scanning voltage amplitude pattern applied to the row direction electrodes to simultaneously scan the electrodes; and separately applying a signal voltage pattern, which is applied to the column direction electrodes, to the electrodes simultaneously scanned in the row direction through two sets or more of the plurality of column direction electrodes which are independent of each other; and simultaneously scanning two or more scanning lines;

whereby image information to be displayed in one frame is formed.

2. The driving method for the organic EL element according to claim 1, comprising:

integrally forming the two or more adjacent rows of the plurality of row direction electrodes as one set of electrodes; and separately driving them by the plurality of column direction electrodes.

3. The driving method for the organic EL element according to claim 2, comprising:

providing low-resistance wiring electrodes as auxiliary electrodes connected to each image display portion of the column direction electrodes.

4. A matrix type organic EL apparatus which has a plurality of row direction electrodes and a plurality of column direction electrodes arranged via an organic light emitting layer and which is capable of displaying a predetermined image, the apparatus comprising:

means for selectively and simultaneously applying an identical scanning voltage amplitude pattern to the plurality of row direction electrodes of two or more rows; and two sets or more of the plurality of independent column electrodes separately apply a signal voltage pattern, which is to be applied to the column direction electrodes, to the row direction electrodes simultaneously scanned in the row direction, wherein two or more of a plurality of scanning lines are simultaneously scanned;

whereby image information to be displayed in one frame is formed.

5. The organic EL apparatus according to claim 4, wherein the two or more adjacent rows of the plurality of row direction electrodes are integrally formed as one set of row direction electrodes.

6. The organic EL apparatus according to claim 4, wherein low-resistance wiring electrodes are provided as auxiliary electrodes connected to each display portion of the column direction electrodes.

* * * * *